United States Patent [19]

Krumm et al.

[11] Patent Number: 4,817,681

[45] Date of Patent: Apr. 4, 1989

[54] WEFT THREAD BRAKE MECHANISM FOR SHUTTLELESS LOOMS

[75] Inventors: Valentin Krumm, Hergensweiler; Siegbert Gsell, Wangen; Gottfried Cramer, Lindau, all of Fed. Rep. of Germany

[73] Assignee: Lindauer Dornier Gesellschaft mbH, Lindau, Fed. Rep. of Germany

[21] Appl. No.: 117,694

[22] Filed: Nov. 5, 1987

[30] Foreign Application Priority Data

Nov. 6, 1986 [DE] Fed. Rep. of Germany ..... 3637919

[51] Int. Cl.[4] ..... D03D 47/34

[52] U.S. Cl. ..... 139/450; 139/370.2

[58] Field of Search ..... 139/429, 450, 453, 370.2; 66/146; 112/154, 155; 242/150, 149

[56] References Cited

U.S. PATENT DOCUMENTS 3,340,903 9/1967 Golobart ..... 139/450

3,688,958 9/1972 Rydborn ..... 139/450

3,797,532 3/1974 Haltmeier ..... 139/450

*Primary Examiner*—Henry S. Jaudon

*Attorney, Agent, or Firm*—W. G. Fasse; D. H. Kane, Jr.

[57] ABSTRACT

A weft thread brake for shuttleless looms has a controllable braking effect. For this purpose, two rows of thread guide eyes are arranged in parallel to each other and between the thread supply reels or coils on the one hand and the thread presenting mechanism on the other hand. Brake leaf springs are arranged individually or in pairs for each weft thread, whereby these leaf springs reach approximately in the direction of the respective weft thread movement and into the space between the two parallel rows of thread guide eyes for cooperation with a common control rail which simultaneously presses all threads of a group of threads against the respective brake leaf spring. The braking action is individually adjustable for each weft thread by properly selecting the characteristics of the respective brake leaf spring or leaf springs.

7 Claims, 4 Drawing Sheets

WEFT THREAD BRAKE MECHANISM FOR SHUTTLELESS LOOMS

FIELD OF THE INVENTION

The invention relates to a weft thread brake mechanism for shuttleless looms. Such brake mechanisms have a controllable braking effect on the weft threads which are individually supplied, each by its respective weft thread supply coil or spool. Each weft thread passes through its own thread brake member as the thread is being pulled off the supply spool.

DESCRIPTION OF THE PRIOR ART

Such weft thread brakes are used in shuttleless looms for enabling the weft thread insertion gripper rods to select the intended weft thread out of a plurality of weft threads while the selected weft thread is held in a stretched out condition. During the weft thread insertion the respective insertion members, for example the grippers which are inserted into the loom shed and which are withdrawn from the loom shed on both sides of the shed, are subject to substantial accelerations and decelerations. After a presented weft thread has been seized by a gripper, the thread is transported very rapidly to the center of the loom shed. As a result, the thread is reeled off rapidly from the supply spool. The weft thread is transferred in the center of the loom shed from the inserting gripper to the withdrawing gripper. The grippers have moved from opposite sides into the shed. During the transfer the just mentioned rapid thread insertion is interrupted for a short period of time. However, directly following the transfer, the thread picked up by the withdrawal gripper is again pulled completely through the loom shed at a high speed. When the thread insertion into the loom shed is completed, the thread is released by the gripper at the end of the insertion path, whereby the thread is stopped. In this type of thread insertion it is important that the weft thread remains taut during the entire time of thread insertion and also, for example during the short interruption of the thread withdrawing operation during the thread transfer from one gripper to the other to avoid a so-called follow motion of the thread which could, for example, result in the formation of curls or loops in the thread, which is to be avoided.

In order to avoid the formation of curls or loops, the above mentioned weft thread brakes are provided. Frequently these brakes are equipped in such a way that they apply a continuous, uniform braking effect to the weft thread. Additionally, these brakes may be equipped to apply a braking effect of differing strengths to the thread in accordance with the different phases of the weft thread insertion. Reference is made in this connection, for example, to Swiss Patent (CH-PS) No. 310,476 which discloses a thread brake having a rigid and a yielding brake member facing each other to form a gap through which the thread is pulled, whereby the brake members are pressed toward each other. One of the brake members cooperates with a mechanical control mechanism. This control mechanism provides for one position in which the brake members are sufficiently spaced from each other across the gap so that the brake members are completely separated from each other. The brake control further provides for periodically changing the spacing across the gap so that at least two further brake positions with differing braking effects are obtained. The control mechanism for one of the brake bodies comprises a cam drive with levers which makes it possible to apply different braking effects in a stepwise manner to the weft thread being pulled off its supply rail. However, due to the cam drive, the braking program or sequence is rigidly determined and cannot be varied during the operation and hence it cannot be adapted to different requirements. Besides, the control mechanism is quite involved and hence expensive due to the use of a cam drive for the levers calling for a plurality of structural components which in turn require a respective space.

Several different types of conventional thread brakes are known and they differ from one another in the form and arrangement of the braking members. For example, thread brakes operating somewhat like a stamp with two disks are known wherein the disks are pressed toward each other by a spring force. The weft thread is being pulled through the gap between the two disks. These so-called disk brakes, however, have the basic disadvantage that the two disks touch each other even in the rest position along an annular contact area. Further, the thread passing through between the disks is subjected to a braking action only at the location or rather locations where it passes through the disk contact area. Hence, the entire braking action is limited to these two locations so that the thread is exposed to a substantial wear and tear. A further disadvantage results when the thread is being pulled through the brake in that these weft threads normally are twisted and that as a result, the brake causes a bunching of the thread twists. Under certain circumstances the braking action may even cause the formation of loops or curls in the thread upstream of the brake as viewed in the feed advance direction of the thread. Such loops or curls may even incapacitate the brake when they pass through the brake. Further, the characteristics of the thread, or rather, the thread quality, may be substantially diminished by the brake due to the above mentioned untwisting effect even if the thread is only partially untwisted.

Another type of thread brake employs leaf springs as the braking members. These leaf springs or so-called lamellae are pressing against a bolt or another leaf spring forming a counter-support. German Patent Publication (DE-OS) No. 3,226,250 discloses such a thread brake with leaf springs. This publication deals in detail with the problem that is caused by the fact that a rapidly withdrawn weft thread must be exposed to different tensions, and hence to different braking actions during different phases of the thread handling cycle. The thread brake according to German Patent Publication No. 3,226,250 corresponding to U.S. Pat. No. 4,479,519 is so constructed that an additional flexible lamella is arranged between a fixed lamella and a removable lamella in such a manner that the weft thread can be exposed to two different braking actions for different thread tensions. Thus, when the movable lamella is pressed against the additional lamella by a reset spring, the weft thread is substantially blocked between the fixed lamella and the additional lamella. On the other hand, when the movable lamella is constantly held by a respective control member away from the fixed lamella, the weft thread is still subjected to a light braking action between the fixed lamella and the additional lamella. In this type of brake the removable lamella is shifted by said control member into two different positions. In one position the removable lamella is bearing against the back of the additional lamella and in the other position the movable lamella is lifted off the additional lamella. The control member for this movement of the movable lamella is a pin-type element which shifts the movable lamella. The arrangement is such that a plurality of brakes are located in a plane for cooperation with a respective number of supply spools or coils. A tiltably mounted sector component carries a control pin for each brake so that all brakes are influenced simultaneously.

The just described thread brake has the serious disadvantage that the thread tension is loosened or reduced simultaneously for all threads including those threads which at the moment are not selected for a thread insertion. Further, the mechanical function of the sector component with the several control pins can be used only for a limited number of brakes or supply coils with the further limitation that all the brakes must be arranged in the same plane. Yet another disadvantage is seen in that the sector component with its control pins has a mass that may not be disregarded when considering the operation of the brake since such mass must be moved and braked in a rapid sequence.

U.S. Pat. No. 3,791,418 discloses a weft thread brake in which each brake disk requires for its operation an electrical circuit with a reed contact. These reed contacts are arranged in a row along an arc and are operated by a switching arm which is tiltable back and forth. This arrangement also requires a substantial number of components and a respective space for these components. Besides, only one brake is activated for one thread at a time while the other brakes remain open or rather not activated during the operation of one of the brakes.

OBJECTS OF THE INVENTION

In view of the foregoing it is the aim of the invention to achieve the following objects singly or in combination:

- to avoid the outlined disadvantages of the prior art, more specifically, to avoid the inadequate control of the thread brakes and to assure that each weft thread is maintained at all times at the required tension;
- to clamp each thread individually for a time period during which the respective weft thread is not needed for the weft thread insertion;
- to keep the effort and expense for the brake construction as small as possible, and to keep the brake itself as light as possible to minimize the masses that must be moved during operation; and
- to make sure that the braking mechanism will operate free of fault even at higher operational speeds of the loom.

SUMMARY OF THE INVENTION

According to the invention the weft thread brake which is controllable in a stepwise manner, and which is located between a plurality of weft thread supply spools on the one hand, and the respective thread presenting device, is characterized in that two parallel rows of thread guide eyes are located so that each weft thread of a group of weft threads passes through two guide eyes between the supply spool means and the thread presenting device. At least one individual leaf spring brake element is arranged between the two rows of thread guide eyes for each weft thread. A common control rail is so located that it can be activated simultaneously for all leaf springs for pressing the weft thread against the respective leaf spring.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
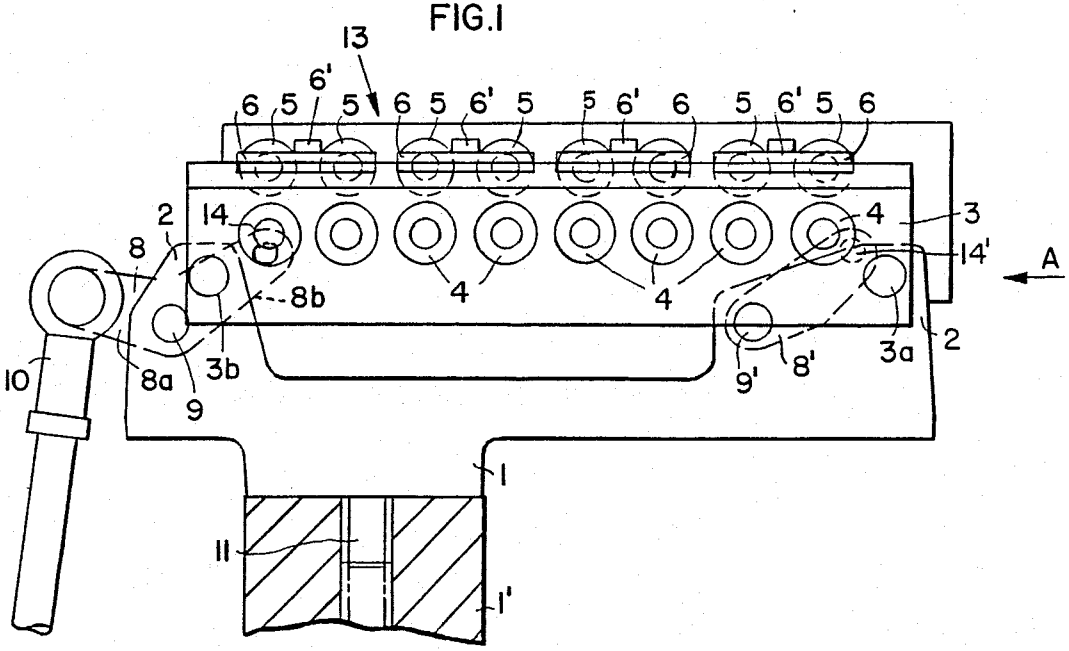
FIG. 1 is a side view of a thread brake according to the invention as seen in the direction of the moving thread which is shown in FIG. 2.
Figure 2A:
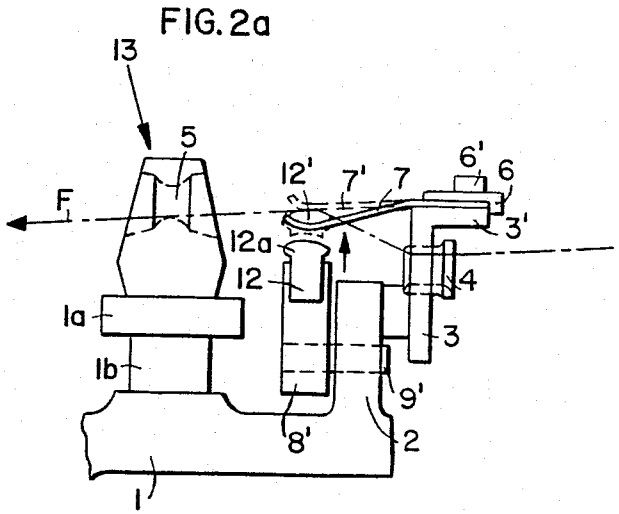
FIG. 2*a* shows a detail of FIG. 2, whereby the rest position of the leaf spring brake elements is shown in full lines while the brake action applying position of the leaf spring brake elements is shown in dashed lines.
Figure 2:
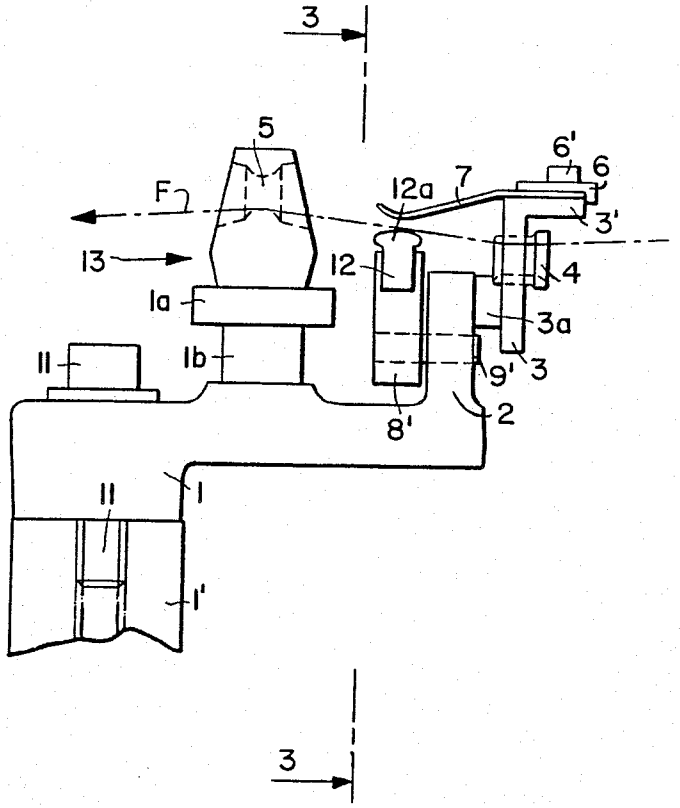
FIG. 2 is a view in the direction of the arrow A in FIG. 1, whereby the leaf spring brake elements are shown in the rest position in which the brake does not apply a braking action to the thread.

FIGS. 1 and 2 show the basic construction of the present weft thread brake mounted on a base- or mounting plate 11 which in turn is secured to the machine frame 1' by a threaded stud 11 or the like. The present brake is mounted between the weft thread supply reels or spools and the weft thread presenting device. The supply spools and the thread presenting device are not shown because they are not part of the invention.

As best seen in FIG. 2, the baseplate 1 has two mounting ears 2 extending from the baseplate edge closer to the supply spools which would be located to the right of FIG. 2 while the thread presenting device would be located to the left of FIG. 2, please see the movement direction of the weft thread F from right to left in FIG. 2. An angular rail 3 having an L-cross-section is secured to the ears 2 by mounting elements 3*a* and 3*b*. The rail 3 is provided with holes in each of which a weft thread guide eye 4 is mounted. These guide eyes 4 are arranged in a row, whereby each supply reel and thus each weft thread F has its own guide eye 4. In the shown example there are eight guide eyes 4. The horizontally extending leg 3' carries a respective number of brake leaf springs 7 secured to the horizontal leg 3' by a bracket 6. Thus, each weft thread F has its own leaf spring 7. The leaf springs 7 are shaped and located so that they are able to cooperate with the respective guide eye 4. The free end of each leaf spring 7 extends in the direction of the weft thread movement. Each bracket 6 holds two leaf springs 7 to simplify the construction. A screw 6' permits releasing its bracket 6 for a leaf spring exchange.

A weft thread monitoring and guiding device 13 comprising further weft thread guide eyes 5, is also mounted on the mounting plate 1 in a position downstream of the rail 3 and downstream of the upstanding ears 2 as viewed in the travel direction of the weft thread F. The guide eyes 5 of the monitoring device 13 are arranged in a row and correspond in number to the number of weft threads and thus to the number of guide eyes 4. For a proper guiding of the weft threads it is desirable that the horizontal on-center spacings between the guide eyes 4 in the rail 3 are the same as the respective horizontal on-center spacings between the guide eyes 5 in the monitoring and guiding device 13. Thus, it is possible that the central axes of a guide eye 4 and of a respective guide eye 5 are approximately aligned with each other in the longitudinal travel direction of a weft thread F. However, such axial alignment is not too critical as shown in FIG. 2 in which the axes of the guide eyes 4 and 5 extend in parallel to each other with the axes of the guide eyes 5 located somewhat higher than the axes of the guide eyes 4. This type of arrangement of the guide eyes 4 and 5 makes it possible to conveniently and quickly thread the weft threads through the guide eyes 4 and 5 substantially simultaneously. The weft threads F are easily accessible from above, whereby the time required for threading these threads through the guide eyes 4, 5 is minimized.

Figure 3:
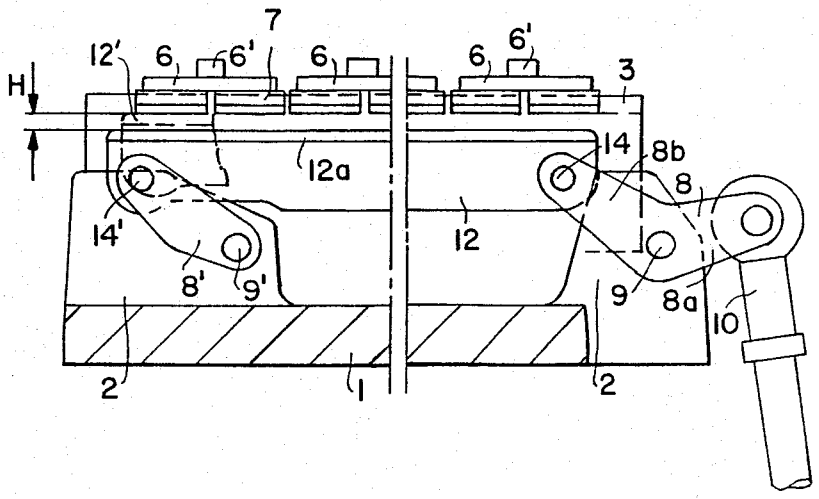
FIG. 3 is a sectional view along section line 3—3 in FIG. 2.

Referring to FIGS. 1, 2, and 3 in conjunction, the free end of the arm 8*a* of a rocker lever 8 is pivoted to a drive and coupling rod 10. The free end of the other arm 8*b* of the rocker lever 8 is pivoted at 14 to a control rail 12 best seen in FIG. 3. The other end of the control rail 12 is connected to a lever 8' is journalled at 9' to the ear 2 as mentioned above and the other end of the lever 8' which is journalled at 14' to the opposite end of the control rail 12, thereby forming a parallelogram type of drive for the control rail 12.

The upwardly facing portion 12*a* of the control rail 12 is slightly curved. The components of the parallelogram drive are so dimensioned that in the rest position of the control rail 12, its upper portion 12*a* is located just below the brake leaf springs 7 as best seen in FIG. 2. The drive and coupling rod 10 is connected to the main machine drive through an eccentric cam control not shown. Thus, when the rod 10 moves up and down in response to its control drive cam, the rail 12 with its top portion 12*a* is also raised or lowered respectively, whereby the top portion 12*a* either contacts the leaf springs 7 to move these leaf springs into the position 7' shown in dashed lines in FIG. 2*a* in which these leaf springs are effective as braking members to press the weft thread F against the curved top surface of the rail portion 12*a* as shown in FIG. 2*a*, or the top surface of the rail 12 is spaced from the leaf springs 7 in the rest position shown in FIG. 2 and in full lines in FIG. 2*a*. By suitably selecting the chacteristics of the leaf springs 7, it is possible to provide the different braking actions for different types of weft threads. The vertical stroke H of the control rail 12 is shown in FIG. 3. This stroke H is the same for all eight, for example, brake leaf springs 7.

The arrangement of the brake leaf springs 7 as disclosed herein makes these springs easily accessible from above so that any spring may be individually exchanged during maintenance work. Since the control rail 12 is moved upwardly against the brake leaf springs 7, any fiber slivers that may be stripped off during a braking action, may sink downwardly without any accumulation of such slivers that otherwise might impair the braking operation.

Figure 2B:
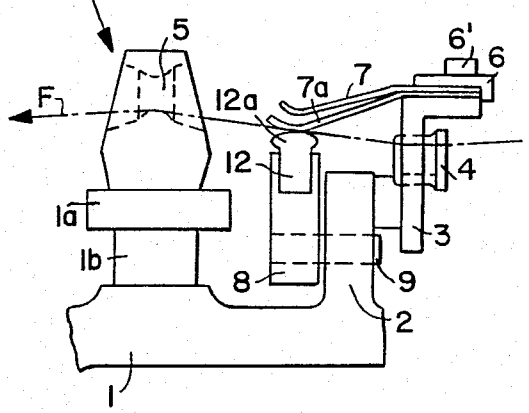
FIG. 2*b* is a view similar to that of FIG. 2*a*, however, in FIG. 2*b* a pair of brake leaf springs is employed for each thread.

FIG. 2*b* shows a modified embodiment in which the individual leaf springs 7 of the first embodiment have been replaced by pairs of leaf springs 7 and 7*a*. The leaf springs forming a pair are so arranged that the leaf spring 7 is located above the leaf spring 7*a* and both springs of a pair are mounted by the bracket 6 as in the other embodiment. The springs are so shaped and located that in the rest position the control rail 12 is definitely spaced from both springs 7 and 7*a*, whereby the weft thread can pass through the gap between the top surface of the portion 12*a* and the leaf spring 7*a* without any braking action being applied to the weft thread F. In a first stage of a braking operation, the top portion 12*a* is pressed only against the lower leaf spring 7*a*, thereby providing a lighter braking action, for example, when it is desired to provide a continuously applied braking action. However, in the embodiment of FIG. 2*b*, the rail 12 may be further raised to a second braking stage to also make the further leaf spring 7 effective for applying a higher braking force. The braking force in the second stage may be so adjusted that the weft thread is completely clamped or blocked. A stepwise raising and/or lowering of the control rail 12 is possible in a very simple manner by respectively shaping the drive cam for the drive and control rod 10. Rather than using a cam for operating the rod 10, the latter may also be driven in steps, for example, by an electromagnetic drive that is controllable in steps without any problems.

Figure 4:
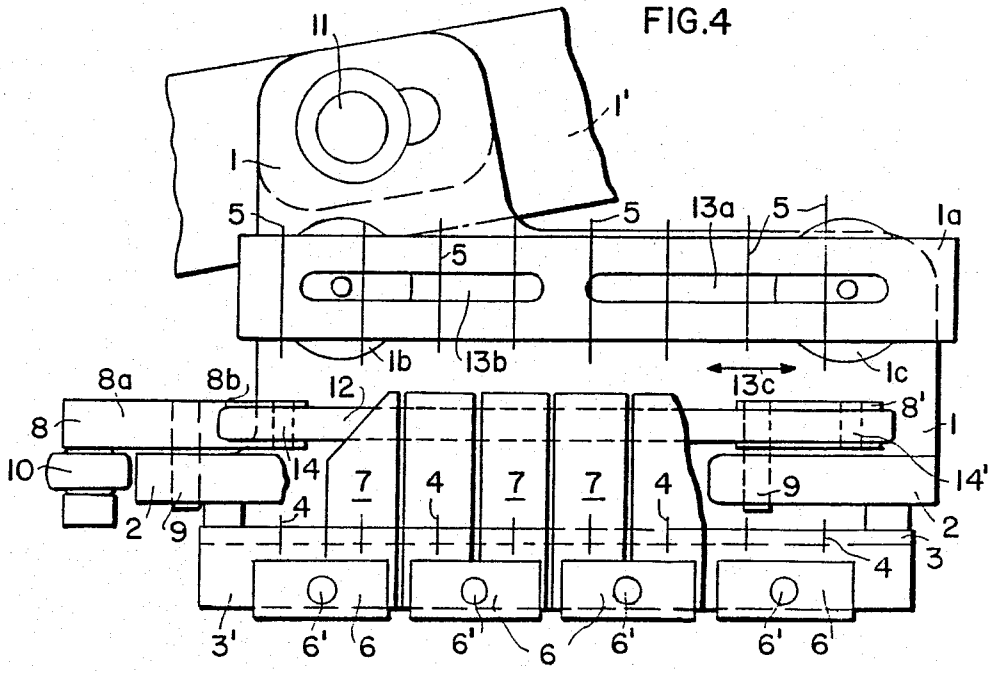
FIG. 4 is a top plan view of FIG. 1.

The top plan view of FIG. 4 shows the rocker lever 8 journalled with its arm 8*a* to the drive and coupling rod 10. A journal shaft 9 supports the rocker lever 8 intermediate its ends for a rocking movement. The other arm 8*b* of the rocker lever 8 is journalled at 14 to; the control rail 12 which is located between the mounting rail 3 and the weft thread monitoring and guiding device 13. Each of the mounting brackets 6 secures two leaf springs 7 to the mounting rail 3. However, some of the leaf springs have been omitted to illustrate the location of the control rail 12. The baseplate 1 comprises a section 1*a* with a machine surface and longitudinal mounting holes 13*a* and 13*b* passing through the section 1*a*. The section 1*a* may be conventionally mounted on studs 1*b* and 1*c*. The weft thread monitoring and guiding device 13 with its guides eyes 5 is mounted in these longitudinal holes 13*a* and 13*b* as mentioned, the position of the monitoring and guiding device 13 is adjustable back and forth in the direction of the arrow 13*c* in the longitudinal holes 13*a* and 13*b* by conventional clamping screws not shown.

Advantages of the invention are seen in that the combined arrangement and use of a weft thread monitoring device with its thread guide eyes 5 on the one hand, and a further row of thread guide eyes 4 results in a thread brake construction which is compact, yet simple, clear, and easily accessible for threading the weft threads into the guide eyes 4 and 5. The guiding of each thread individually upstream and downstream of the brake leaf springs asures a proper presentation of each thread individually to its respective thread brake so that the brake force is applied where it is needed and uniformly, yet individually to all threads.

Due to the stepwise operation of the brake mechanism comprising pairs of leaf springs 7, 7*a* for each thread F it is possible to cause most varied braking effects individually for each thread. For example, the leaf springs 7*a* may have a thickness of about 0.1 to 0.2 mm for applying a light continuous braking action while the leaf springs 7 may have a thickness of 0.6 to 0.8 mm for a substantially reinforced braking action which may even block or stop the respective thread.

The present brake mechanism is also very suitable for adaptation to threads of different yarn types, for example, coarse or heavy yarn. Such adaptation is accomplished by simply exchanging one type of brake leaf springs by another type, for example, having a larger or smaller thickness. The exchange is easily accomplished by loosening the mounting brackets 6, for example, with a respective screw 6'.

In addition to the above mentioned compactness of the present thread brake, it also has but small masses that must be moved, namely the control rail 12, the rocker lever 8, and the lever 8'. Similarly, only small masses need to be subjected to a braking action. As a result, the present thread brake is also suitable for looms operating at high speeds. Another advantage of the present thread brake is seen in that it requires but a few journal mountings so that wear and tear is minimized and so that the apparatus has little play. The present brake is also suitable for situations requiring simultaneously pulling and braking of several threads, for example, thin smooth threads passing through one pair of guide eyes and coarse heavy yarns with burls passing through an other pair of guide eyes located adjacent to the first pair of guide eyes, for example.

Although the invention has been described with reference to specific example embodiments, it will be appreciated, that it is intended to cover all modifications and equivalents within the scope of the appended claims.

What we claim is:

1. A weft thread brake mechanism for controlling the tension of weft threads in shuttleless looms, comprising a first plurality of thread guide eyes and a second plurality of thread guide eyes, mounting means for mounting said first plurality of thread guide eyes in a first row and for also mounting said second plurality of thread guide eyes in a second row in such a way that said first and second rows of thread guide eyes extend in parallel to each other, whereby a thread guide eye in one row is located for cooperation with a respective thread guide eye in the other row so that a thread must pass through both thread guide eyes forming a pair, a plurality of individual thread brake leaf spring means mounted on said mounting means for individually applying a braking force to a respective weft thread intermediate said first and second rows of thread guide eyes, a control rail for controlling the operation of said leaf spring means, journal means for movably securing said control rail to said mounting means intermediate said first and second rows of thread guide eyes and below said leaf spring means so that said control rail can be moved between a rest position and an operating position below said weft threads, said control rail pressing said weft threads directly from below against the respective leaf spring means, and drive means operatively connected to said control rail for simultaneously pressing said control rail from below directly against said weft threads and thus against all of said leaf spring means.

2. The weft thread brake of claim 1, wherein said drive means for said control rail comprise coupling lever means journalled to said mounting means and to said control rail for forming a parallelogram type of drive and a drive rod pivotally coupled to said parallelogram type of drive, said drive rod being operable for transmitting a drive force to said parallelogram type of drive.

3. The weft thread brake of claim 2, wherein said drive rod can move said parallelogram type drive and said control rail into different positions for applying different braking forces to said thread and for moving said control rail into an inoperative rest position.

4. The weft thread brake of claim 1, further comprising mounting brackets for securing said leaf spring means to said mounting means, and releasable means holding said mounting brackets in a releasable manner for readily exchanging said leaf spring means in accordance with requirements of different types of weft threads.

5. The weft thread brake of claim 1, wherein said leaf spring means comprise a pair of leaf springs for each weft thread in a group of weft threads, each leaf spring of a pair of leaf springs having a different brake force application characteristic, and wherein the leaf springs of a pair are arranged one above the other, both leaf springs being located so that a weft thread can be pressed against the lower leaf spring of a pair and so that the upper leaf spring of a pair becomes effective after the lower leaf spring of a pair is effective.

6. The weft thread brake of claim 1, wherein said second row of thread guide eyes forms part of a weft thread monitoring and guiding device.

7. The weft thread brake of claim 1, further comprising a spacing between said first and second row of thread guide eyes, said leaf spring means being mounted to reach partially across said spacing, said leaf spring means extending in a direction approximately corresponding to the travel direction of a respective weft thread, said control rail being located in said spacing below said leaf spring means, whereby a braking action is applied to a portion of said weft thread between its two respective thread guide eyes.

* * * * *